United States Patent [19]

Dubourg

[11] 4,271,600

[45] Jun. 9, 1981

[54] APPARATUS FOR DRYING FLAT ARTICLES OF POROUS MATERIAL UNDER VACUUM

[75] Inventor: Jean-Pierre Dubourg, Segny Gex, France

[73] Assignee: Patpan Inc., Panama

[21] Appl. No.: 937,589

[22] Filed: Aug. 28, 1978

[30] Foreign Application Priority Data

Sep. 2, 1977 [CH] Switzerland ..... 10706/77
Jan. 26, 1978 [GB] United Kingdom ..... 3132/78

[51] Int. Cl.[3] ..... F26B 13/30
[52] U.S. Cl. ..... 34/92; 34/112; 34/123
[58] Field of Search ..... 34/51, 70, 71, 87, 92, 34/95, 95.1, 108, 110, 111, 112, 123, 128, 140, 148, 151, 186, 184, 242

[56] References Cited

U.S. PATENT DOCUMENTS 1,762,309 6/1930 Roesen ..... 34/112
3,253,351 5/1966 Bettanin ..... 34/92

FOREIGN PATENT DOCUMENTS 2739015 3/1978 Fed. Rep. of Germany ..... 34/92
438475 11/1935 United Kingdom ..... 34/71

*Primary Examiner*—Albert J. Makay
*Assistant Examiner*—Harold Joyce

[57] ABSTRACT

The present invention relates to an apparatus for drying under vacuum flat articles of porous material which apparatus comprises a support surface for supporting at least one article to be dried, a heating means disposed on the side of the support surface opposite to the side supporting the flat articles, at least one cover means serving to enclose at least one article to be dried, which is spread on the corresponding portion of the support surface, in a hermetically-sealed space, and means enabling the connection of the hermetically-sealed space to a vacuum creating device. The cover means employed comprises a flexible but non-extensible, fluid tight diaphragm which is provided on the side facing the support surface with a cushion layer of porous material and on its periphery with a fluid-tight seal for coaction with the support surface to provide the hermetically-sealed space.

14 Claims, 9 Drawing Figures

APPARATUS FOR DRYING FLAT ARTICLES OF POROUS MATERIAL UNDER VACUUM

BACKGROUND OF THE INVENTION

1. Field of the Invention

The present invention relates to an apparatus for drying flat articles, and more particularly, to a drying apparatus which utilizes a vacuum-generating device for enhancing the speed of the drying operation.

2. Description of the Prior Art

In a first category of known drying apparatus of the kind mentioned, the surface serving to support the flat articles to be dried is a heated plane surface, oriented to be in a horizontal or inclined position, and of relatively limited dimensions, so that the operators can lay thereon the articles to be dried. However, the minimum economically acceptable dimensions do not allow the operators to lay out readily all portions of the articles or pieces to be dried, so that some portions often cannot be handled as well as is required to produce good work, thus resulting in a loss in the useful area of the articles and in a substantial economic loss. Moreover, the limited dimensions of the plane support surface do not enable the drying of articles of large dimensions which must therefore be divided, thus becoming unsuitable for certain uses and of consequently reduced value.

Furthermore, the production provided with the aid of a single heated support surface is relatively small. A moderate industrial production necessitates a plurality of these apparatus. In the case of known plane support surfaces, this multiplication of the individual apparatus or a group of such apparatus is costly and the apparatus occupy a substantial space.

In another category of known apparatus, the flat articles to be dried are deposited on a heated cylindrical support surface partially surrounded by an endless flexible band rotating intermittently. Complete drying cannot be effected in practice in such apparatus because:

(a) if the flexible endless band is fluid-tight, it cannot allow any evaporation of liquid contained in the articles to be dried;

(b) if the flexible endless band is porous, it will allow a very slow evaporation of the liquid, but experience has shown that articles to be dried containing generally 60–100% by weight of liquid in relation to the dry material require a drying duration of about 30 minutes at a temperature of about 90° C. which is not acceptable for good quality products. A temperature lower than 50° C., as necessary to preserve the quality of the products, requires a drying duration of from one to three hours.

The resultant production of an apparatus of this kind is thus reduced to only several articles per day, which shows that this idea does not give rise to effective utilization. In fact, apparatus of this kind are used only for ironing or finishing of the articles and not for drying.

The present invention has primarily as its object to provide an apparatus for drying under vacuum flat articles or pieces of porous material, which avoids the disadvantages referred to hereinbefore and facilitates the work of the operators by allowing them to operate continuously at the same place, situated at a convenient height, and at a suitable small distance in front of them. Another object of the invention is to provide an apparatus of the noted kind which is of relatively compact construction and does not require substantial manipulating space in order to open and to close the one or more cover means.

SUMMARY OF THE INVENTION

The apparatus in accordance with the invention is characterized in that the support surface has a cylindrical shape and is arranged in such a manner as to be able to turn about its axis and that the cover diaphragm is adapted to the cylindrical heated support surface. Thanks to the construction in accordance with the invention, articles to be dried containing 60–100% by weight of liquid in relation to the dry material can be dried in a time period of between one and five minutes at a temperature below 50° C., which ensures that the products are of good quality. The production of an apparatus in accordance with the invention is therefore satisfactory for effective industrial use.

Also owing to the construction in accordance with the invention, the orientation and the rotation of the support surface enables all portions of the articles to be dried to be presented successively to the operators at a convenient distance in order to allow the laying out of the articles under the best possible conditions, regardless of the dimensions of the articles, i.e., if the axial length of the cylindrical surface support and its circumference is adapted to the largest dimensions of the articles to be dried.

For production runs involving articles of smaller dimensions, the cylindrical support surface can be divided into several sectors, each covered by an independent cover diaphragm, each sector thus constituting a separate drying unit, the drying units being presented successively to the operators, which enables the construction of a compact apparatus, which is more economic and less bulky, whilst at the same time facilitating good lay out of the articles to be dried over all the parts thereof.

The details and the advantages of several embodiments of apparatus in accordance with the invention will be apparent from the claims and description which follow, given by way of non-limiting example and referring to the accompanying drawings.

DETAILED DESCRIPTION OF THE PREFERRED EMBODIMENTS

Figure 1:
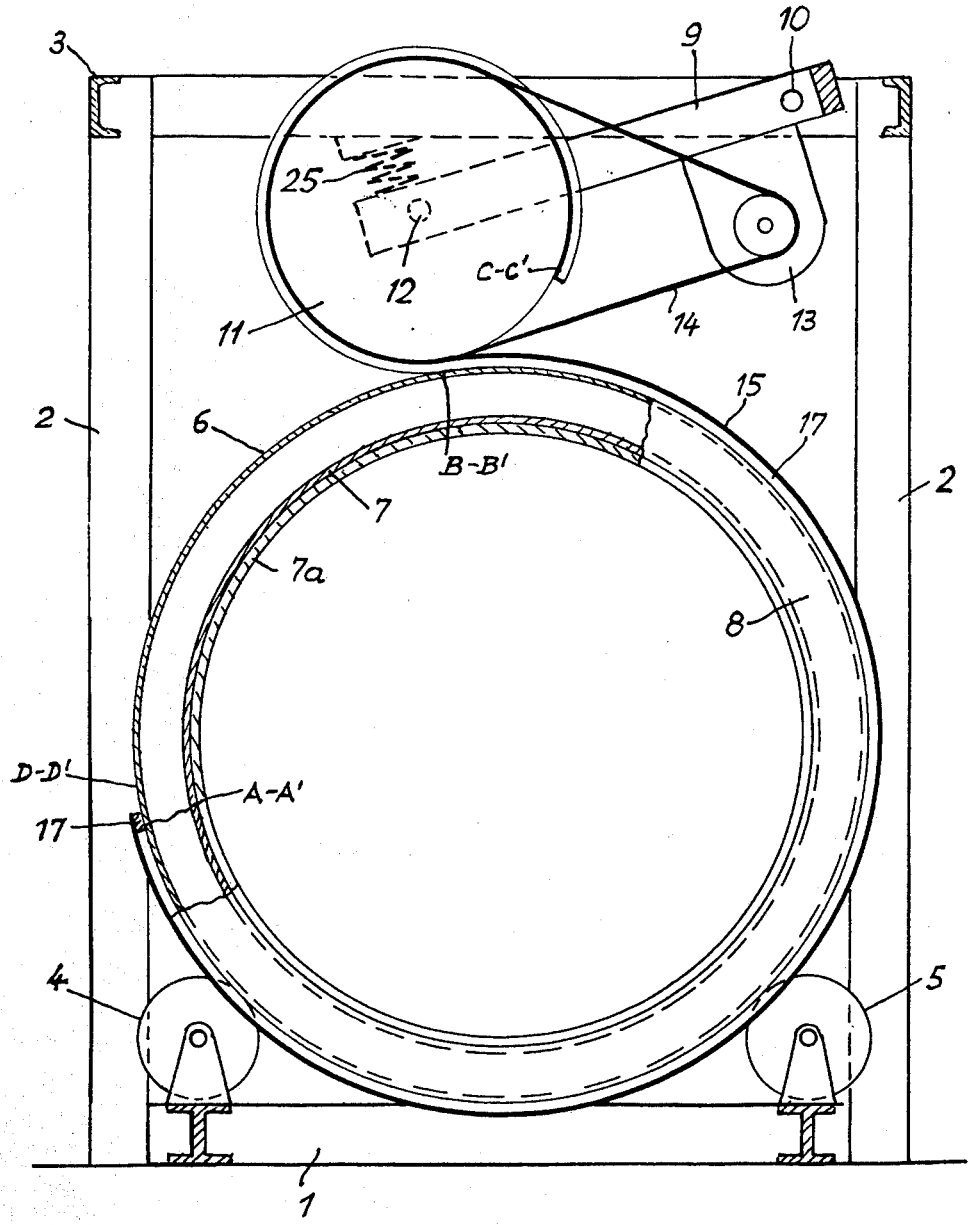
FIG. 1 is a diagrammatic transverse sectional view of one embodiment of apparatus in accordance with the invention, with a single drying sector for articles of large dimensions.
Figure 2:
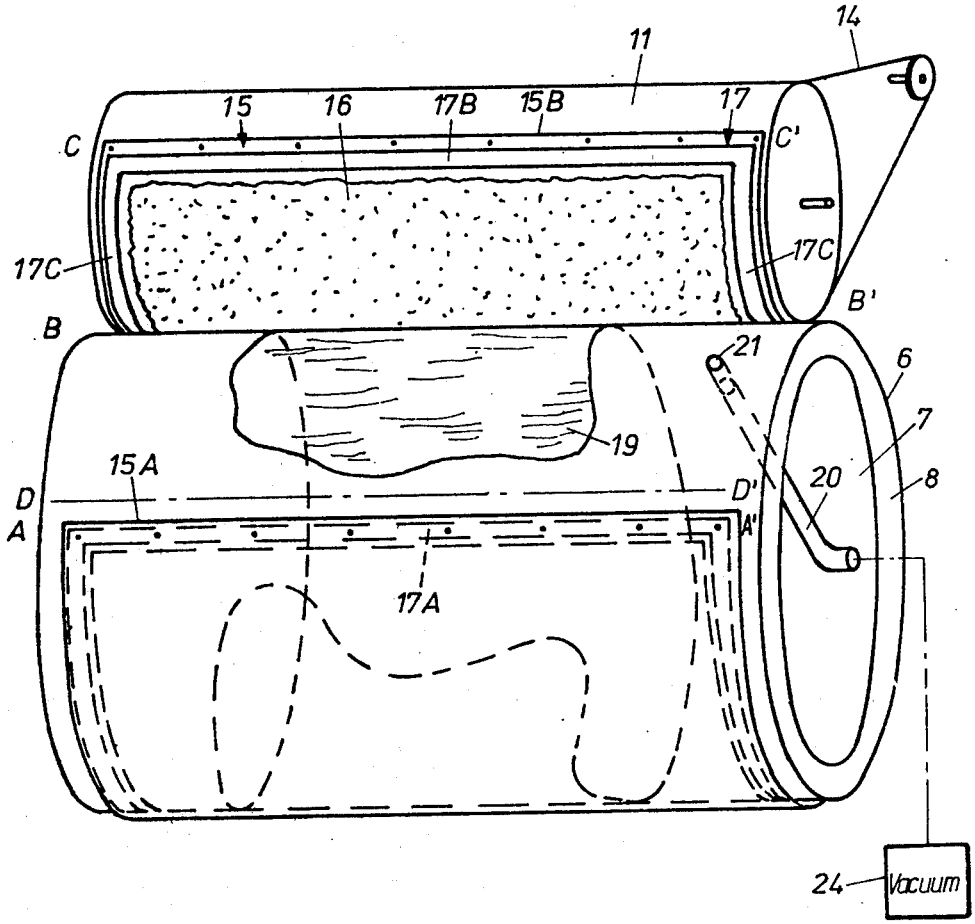
FIG. 2 is a diagrammatic perspective view of the same embodiment of the apparatus in accordance with the invention showing an article to be dried while being laid out.
Figure 3:
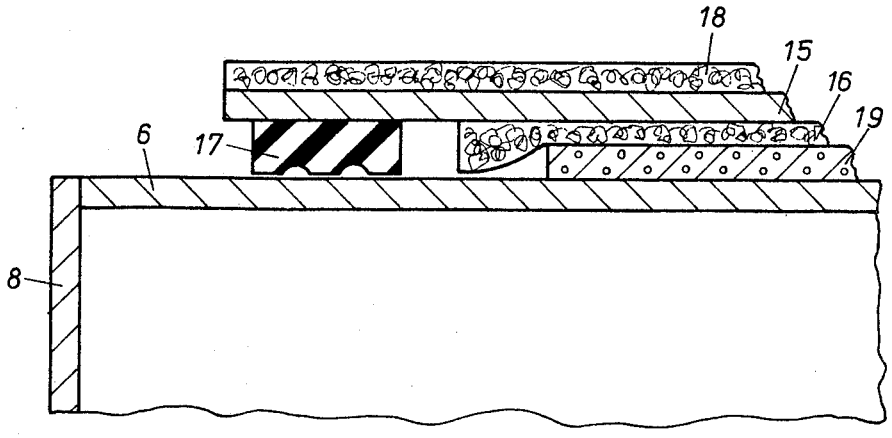
FIG. 3 is a partial section view following the plane of a generating line of the cylindrical heated support surface of the same embodiment of apparatus in accordance with the invention.

An embodiment of apparatus in accordance with the invention, as shown in FIGS. 1 to 3, comprises a stationary base 1 to which are secured at each end, two frames 2 interconnected by cross-members 3, the assembly defining a volume in the form of a rectangular parallelepiped.

Towards the ends of the base 1 two pairs of rollers 4 and 5 are mounted for free rotation about their axes. A double-walled cylinder rests on the four rollers and is formed by an outer annular-section member 6 of metal or plastic material, not liable to corrosion or alternatively protected against corrosion, and of a second annular-section member 7 concentric with the interior of the member 6 and having the same characteristics. These two members are connected by end plates 8 of annular form, the assembly defining a closed volume filled with a fluid maintained by any known means (not shown) at a constant temperature which can be controlled and adjusted by a thermostat.

The inner surface of the member 7 is covered by a thermal insulation layer 7*a*.

A frame of profiled members 9 pivoted at 10 on the upper transverse members of the frame 2 supports a drum 11 which can be rotated about its shaft 12 by means of a reversible motor/reduction gear 13 operable at different forward and backward speeds, connected to the drum 11 by means of a transmission belt 14.

A fluid-tight, flexible, but non-extensible rectangular diaphragm 15 (FIGS. 1 and 2), preferably of synthetic material, is secured, at its one edge 15A to the member 6 following a straight generating line A-A$^1$ and surrounds the member 6 up to its generating line B-B$^1$ where it contacts the drum 11, and furthermore the diaphragm 15 is wound on the said drum 11 to which it is secured, at its opposite edge 15B, along the generating line C-C$^1$. The length of this diaphragm 15 corresponds substantially to that of the circumference of the member 6, whilst the width of the diaphragm is slightly less than the axial dimension of the member 6.

The diagram 15 (FIGS. 1, 2 and 3) is provided, on its side facing the member 6, with a cushion layer of porous material 16, which lies within the perimeter defined by a fluid-tight seal 17, which is secured in a fluid-tight manner on the periphery and adjacent to the edges of the diaphragm 15.

A flexible layer of thermal insulating material 18 (FIG. 3) is secured on the outer face of the diaphragm 15 in order to reduce loss of heat.

It will thus be seen that when simultaneous rotation of the member 6 and of the drum 11 have brought the edge 15B of the diaphragm 15 following the generating line C-C$^1$ of the drum 11 into contact with a generating line D-D$^1$ of the member 6 at the common position B-B$^1$, the diaphragm 15 completely surrounds the member 6 and the fluid-tight seal 17 is applied at its opposite sides 17A and 17B onto the two generating lines A-A$^1$ and D-D$^1$ of the member 6 and, by its lateral sides 17C, onto two circumferential arcs of the member 6, thus defining, between the member 6 and the fluid-tight diaphragm 15 a hermetically-sealed space intended to enclose an article to be dried 19 previously laid out on the member 6, as can be seen in FIG. 3 which shows a section in a radial plane of a generating line of the member 6.

One or more tubes 20 (FIG. 2) pass through the inner member 7 and are connected to orifices such as 21 at the outer surface of the outer member 6, at the interior of the perimeter circumscribed by the seal 17. The tube or tubes 20 is/are connected to a vacuum source 24 through the intermediary of a rotary seal (not shown) of known type.

Between the upper transverse members of the frames 2, on the one hand, and the ends of the frames 9 supporting the drum 11, on the other hand, two strong springs 25 are located, respectively, in order to urge the drum 11 towards the outer member 6.

At the commencement of an operational cycle, the diaphragm 15 is completely wound onto the drum 11, leaving completely exposed the whole of the outer surface of the member 6, the generating line A-A$^1$ being coincident with the common contact line B-B$^1$ of the member 6 and the drum 11. The operators commence by laying out one end of an article to be dried 19 on the member 6, as close as possible to the generating line B-B$^1$. From this instant, the motor/reduction gear 13 is started so that it commences to turn the drum 11 counter-clockwise (FIG. 1), at a slow speed. Because of the action of springs 25 on the ends of the frame 9, the drum 11 presses strongly the diaphragm 15, the cushion layer 16 and the seal 17 against the member 6 following the generating line B-B$^1$, which causes the cylinder 6–8 to rotate in the clockwise sense. During the course of this rotation, the article to be dried 19 progressively envelops the member 6, which enables the operators readily to ensure a perfect laying out of all portions of the article to be dried 19 on the member 6. Furthermore, the pressure exerted by the springs 25 and the tension of the diaphragm 15 on the member 6 maintain the article to be dried 19 firmly pressed onto the member 6, which prevents any retraction of the article to be dried whilst the operation of laying out is continued.

When the diaphragm 15 is completely unwound from the drum 11, the generating line C-C$^1$ having reached the position B-B$^1$, the article to be dried 19 is completely enclosed within the hermetically-sealed space defined by the member 6, the diaphragm 15 and the seal 17.

The vacuum source 24 is then brought into operation in order to generate a vacuum in the hermetically-sealed space and extracts the liquid impregnating the article to be dried 19, which liquid is vaporized both under vacuum and as the result of the application of heat provided by the fluid contained in the space between the members 6 and 7. The article under treatment being firmly and continuously pressed between the member 6 and the cushion layer 16 of the diaphragm 15, shrinkage of the article during drying is practically prevented. When the desired degree of drying is achieved, the vacuum is cut off and the motor/reduction gear 13 is put into reverse, thus driving the drum 11 at a fast speed in the clockwise direction (FIG. 1), which has the action of winding the diaphragm 15 onto the drum 11 and releasing the dry article 19 rapidly.

When the diaphragm 15 is completely wound onto the drum 11, the generating line A-A$^1$ of the member 6 is again at the position B-B$^1$ and the apparatus is ready for a fresh operational cycle.

Figure 4:
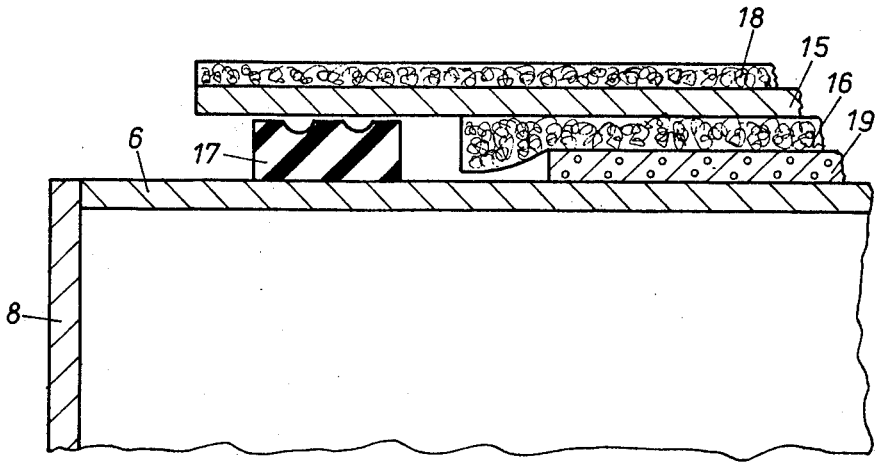
FIG. 4 is a modification of FIG. 3 in which the fluid-tight seal is connected to the cylindrical heated surface instead of being connected to the cover diaphragm.

According to a modification illustrated in FIG. 4, the seal 17 is secured in a fluid-tight manner to the member 6 instead of to the diaphragm 15. The operation of the so modified apparatus is the same as described.

Figure 5:
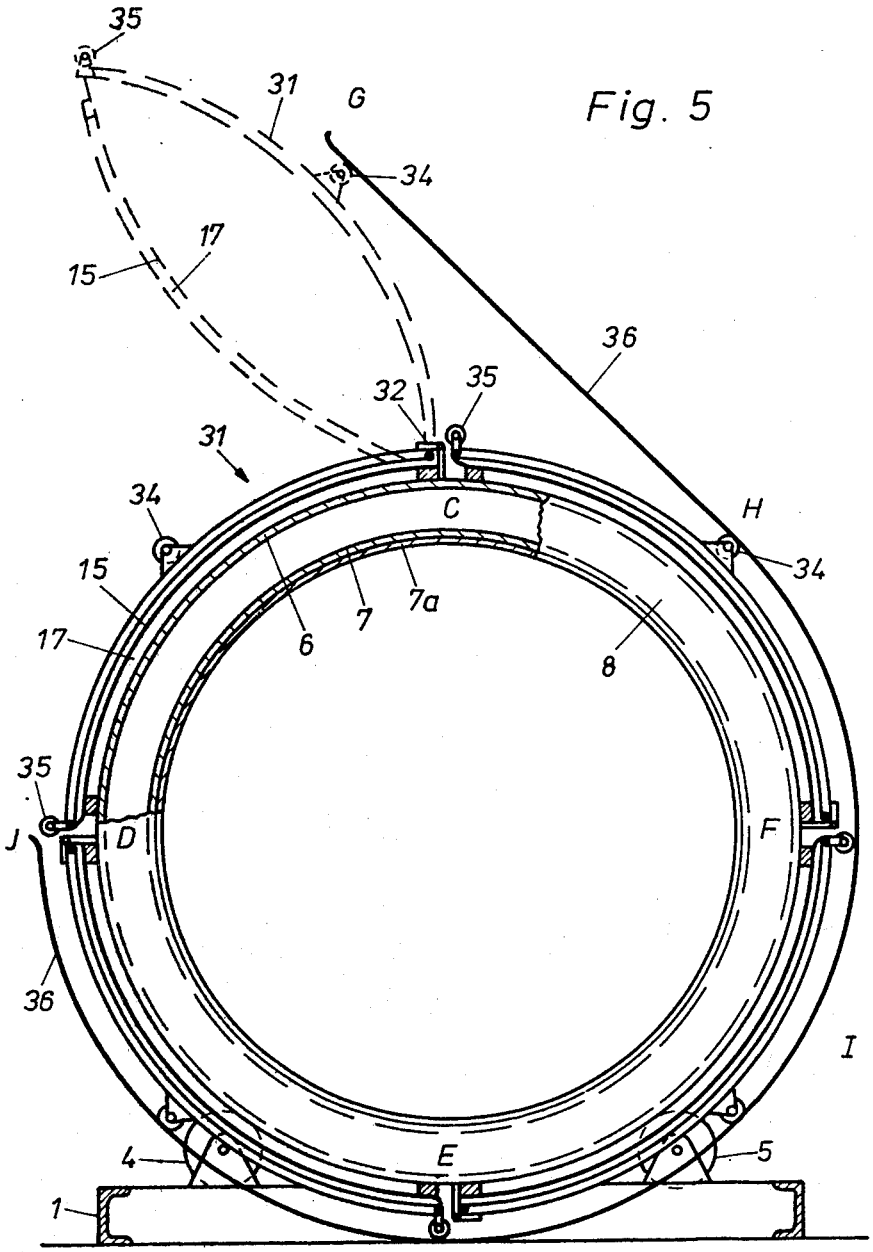
FIG. 5 is a diagrammatic transverse section view of another embodiment of apparatus in accordance with the invention, with several drying sectors.
Figure 6:
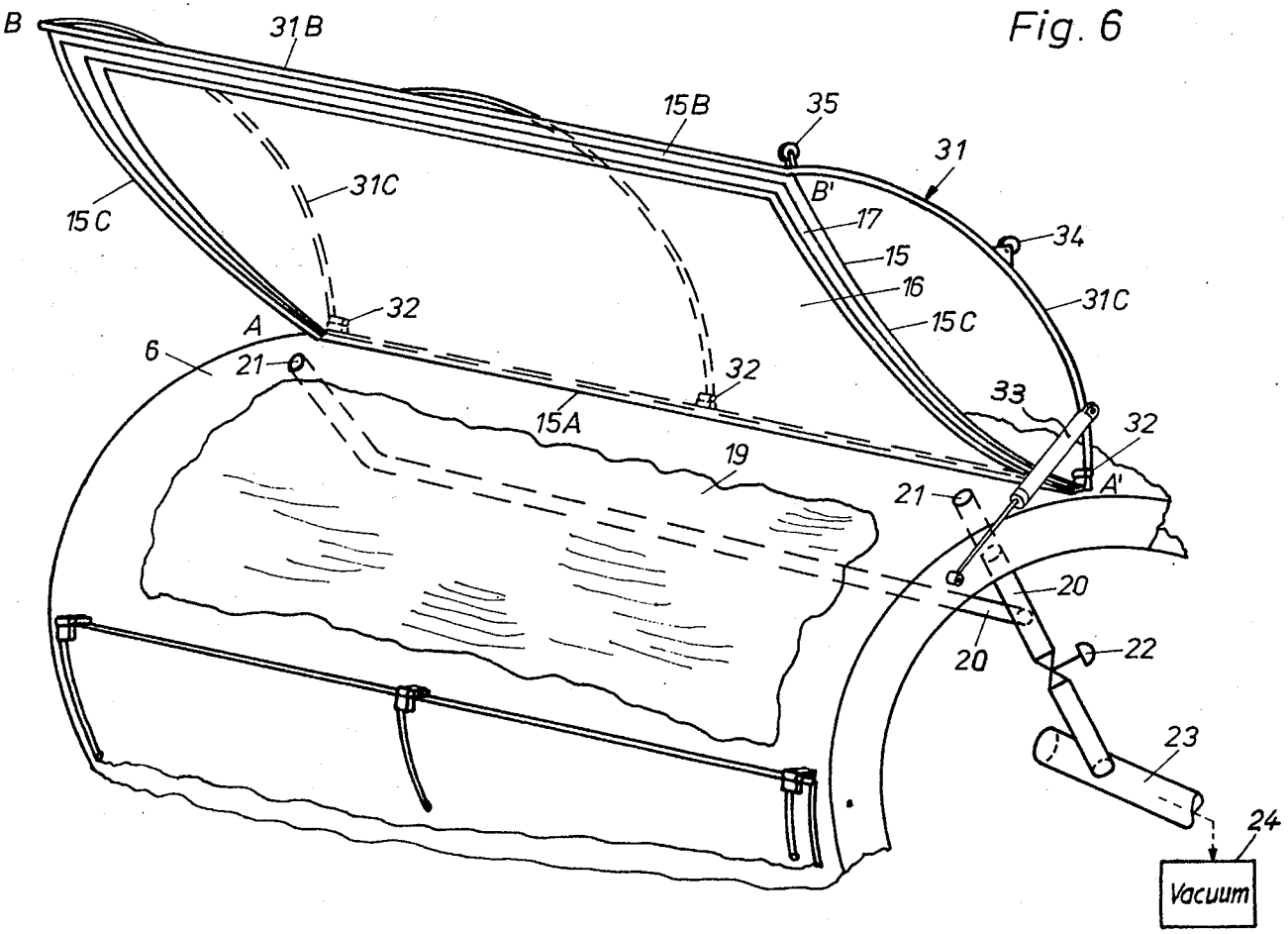
FIG. 6 is a perspective view of one of the drying sectors of the apparatus according to FIG. 5.
Figure 7:
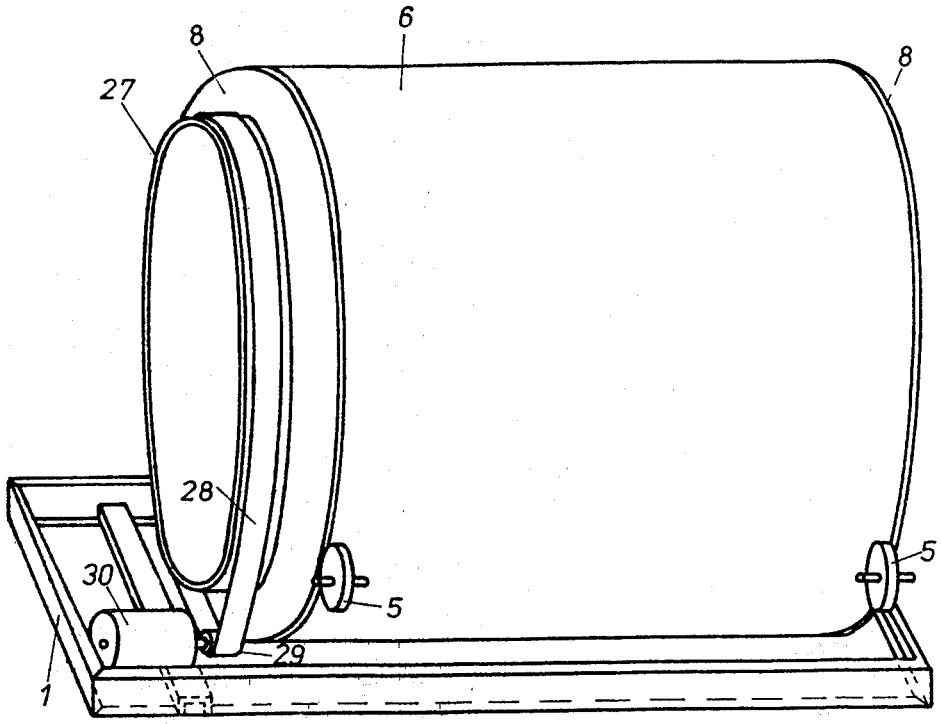
FIG. 7 is a rear perspective view showing one method of rotating the support surface of the apparatus in accordance with FIG. 5, without the cover means.

Another embodiment by way of example of an apparatus in accordance with the invention shown in FIGS. 5–7, comprises a stationary base 1, towards the ends of which two pairs of rollers 4 and 5 are mounted which are freely rotatable about their axes. A double-walled cylinder rests on these four rollers and comprises an outer member 6 of metal or plastic material, which is not liable to corrosion or is protected against corrosion, and a second member 7 concentric with the interior of the member 6 and having similar characteristics. The two members 6 and 7 are connected by end plates 8 in the form of rings, the assembly forming a closed volume filled with a fluid maintained by any known means (and not shown) at a constant temperature which can be adjusted and controlled by a thermostat. The inner surface of the member 7 is covered by a thermal insulating layer 7*a*.

At one of the ends of the cylinder 6 to 8 (FIG. 7) the member 7 has a length somewhat greater than that of the member 6, this excess forming a rim protuding 27 serving as a drive pulley for rotating the cylinder on the rollers 4 and 5 by means of a belt 28, itself driven by a pulley 29 of a variable speed motor/reduction gear 30.

In the present embodiment of apparatus in accordance with the invention the outer surface of the member 6 is divided into four equal sectors C-D, D-E, E-F and F-C, the number of sectors not being limiting neither upwards nor downwards.

Each of the four sectors (FIGS. 5 and 6) is equipped with a cover comprising a frame 31 of profiled members or of tubes or again a sheet steel shell or a shell of plastic material. Each frame 31 has a form corresponding to a quarter of the circumference of the member 6 and is capable of being opened and closed by means of hinges 32 of which one part is secured onto the member 6 so that the pivot axis of the hinges 32 is parallel to one generating line A-A$^1$ of the member 6. These hinges operate in conjunction with a helical spring means 33 which is sufficiently strong to always return the cover to the open position when it is released.

The frame 31 serves to support a rectangular diaphragm 15, which is fluid-tight but flexible and non-extensible, preferably of a synthetic material, and which is fixed by one edge 15A of its edges, on the member 6 following the generating line A-A$^1$, and by its opposed edge 15B on one side 31B of the frame 31, remote from the hinges 32. The two lateral edges 15C of the diaphragm 15 remain free and their length corresponds to the length of the circumferential arc of the member 6 covered by the frame 31.

The diaphragm 15 is provided, on its side facing the member 6, with a cushion sheet of porous material 16, which lies within the perimeter circumscribed by a fluid-tight seal 17, which is secured in a fluid-tight manner on the periphery and adjacent to the edges of the diaphragm 15. On the outer face of the diaphragm 15 a flexible layer of insulating material is secured (not shown) in order to avoid heat loss.

It will be apparent that when the frame 31 is moved to its closed position against the member 6, the seal 17 is applied along its four sides onto the member 6, thus defining between the member 6 and the diaphragm 15 a hermetically-sealed space intended to enclose an article to be dried 19 previously laid out on the member 6, as can be seen in FIG. 3, which shows a section in a radial plane of a generating line of the member 6.

Several tubes 20 pass through the inner member 7 and are connected to orifices 21 at the outer surface of the member 6, within the perimeter circumscribed by the seal 17 in the closed position of the cover. The tubes 20 are interconnected, and are also connected to a distributing valve 22 and finally to a manifold 23 which itself is connected to a vacuum source 24 through the intermediary of a rotary seal (not shown). Similarly, tubes coming from orifices lying in the other sectors are connected to further distributing valves which all are in connection with the manifold 23, each sector C-D, D-E, E-F, F-C having associated an individual distributing valve.

Two small wheels 34 and 35 are mounted on each of the lateral sides 31C of the frame 31, one of the small wheels, 34, being situated approximately at the centre and the other 35 at the end remote from the hinge 32 associated with the side in question. The small wheels 34 and 35 turn freely on their axes which are parallel to the generating lines of the member 6. The ends of the member 6 are partially surrounded by two fixed cam members 36 (FIG. 5) disposed radially outward of the lateral sides 31C of the frames 31 so that the small wheels 34 and 35 can roll on the inside of the cam member 36. The cam members 36 are of small width and each has the form of a semi-circle HIJ with a rectilinear extension GH tangential to one end of said semi-circle. The cam members 36 are arranged so as to maintain all the covers less one in closed position. By means, not shown, the cam members 36 are secured to the base 1.

At the commencement of an operational cycle, the cover formed by the frame 11 and the diaphragm 15 of the first sector C-D of the apparatus (FIG. 5) is opened by the action of the springs of hinges 32, as illustrated in broken lines in FIG. 5.

The operators commence by laying out one end of an article to be dried 19 onto the sector C-D of the member 6, as close as possible to the generating line A-A$^1$. From then on the motor-reduction gear 30 causes the cylinder 6–8 to rotate in a clockwise sense (FIG. 5). During rotation of the member 6, the article to be dried 19 progressively envelops the outer surface of the member 6, which enables the operators to readily ensure a perfect laying out of all portions of the articles to be dried 19 on the member 6. Simultaneously, the two small wheels 34 mounted on the lateral sides 31C of the open frame 31 start to roll on the interior of the two fixed cam members 36, whereby the small wheels progressively close the cover by rolling on the rectilinear portion G-H of the cam members. When the small wheels 34 have reached the point H, the sector C-D reaches the position F-C and the cover 15, 31 is completely closed. At this instant, the distributing valve 22 of the considered sector is opened, in order to apply the vacuum below the diaphragm 15 and to start the drying in this sector. The cover 15, 31 is then held closed both by the action of the vacuum and by the action of the two cam members 36.

The sector which was initially in the position D-E then reaches the position C-D. The small wheels 35 which hold the corresponding cover 15, 31 closed are disengaged from the cam members 36 which terminate at J and the cover opens by the action of the springs of the hinges 32. The operators then commence to spread out another article to be dried on the second sector of the member 6 and the cycle of operations described above is repeated at the second, third and fourth sectors until the first sector returns to its initial position C-D. Then the associated vacuum valve 22 is closed and the relative cover 15, 31 is automatically opened, thereby releasing the first dried article 19.

The speed of the variable speed motor/reduction gear 30 is controlled so that the time necessary to obtain the desired degree of dryness corresponds to the rotation of $\frac{3}{4}$ of a turn of the cylinder 6–8. The control of the vacuum valve 22 can advantageously be made automatic with the aid of known control means, so that any one of the vacuum valves 22 closes and cuts off the vacuum to the associated sector when and as long as the latter is in its initial position C-D. There is thus provided continuous operation with a productivity which is higher because the operators do not need to make any intervention in order to effect the operation and they can then give all their time to work on the articles to be dried.

The diameter and the length of the member 6 and the number of sectors can be varied as a function of the dimensions of the articles to be dried and of the production to be effected.

Figure 8:
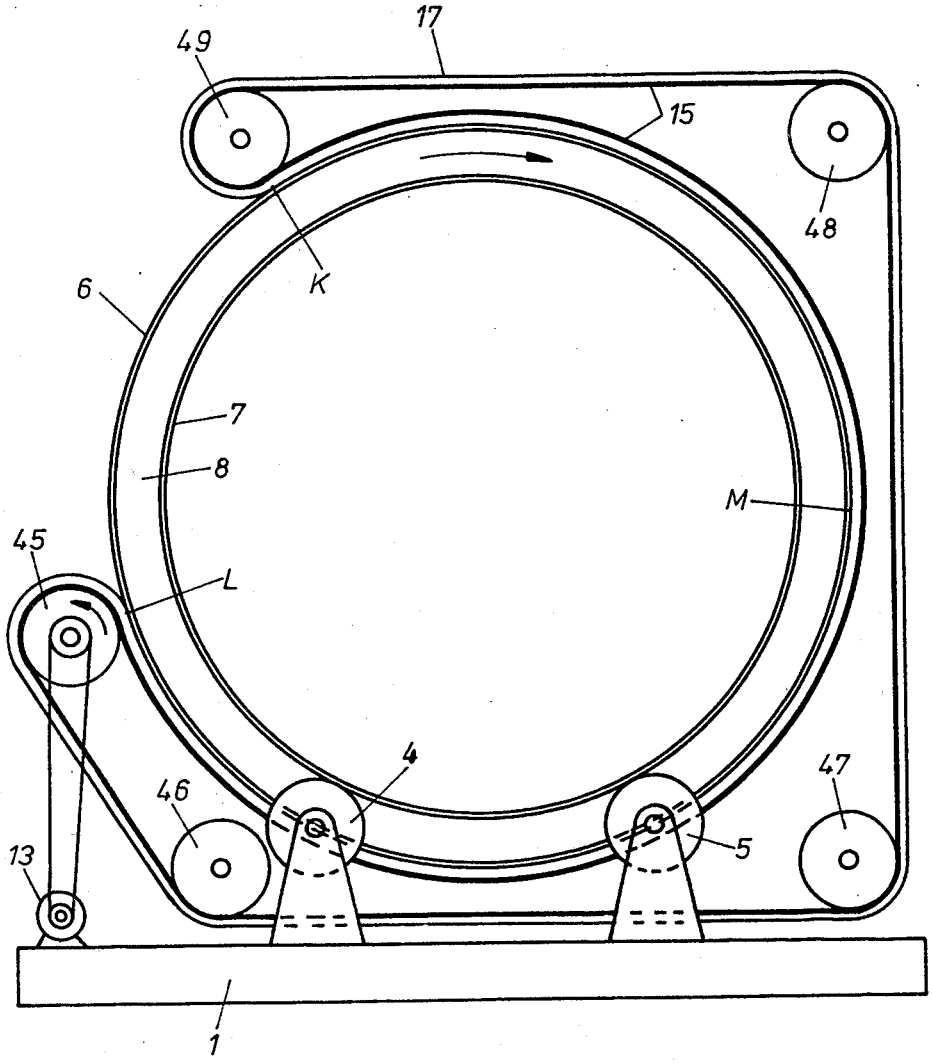
FIG. 8 shows a diagrammatic cross-section view of yet another embodiment of apparatus in accordance with the invention, operable continuously.
Figure 9:
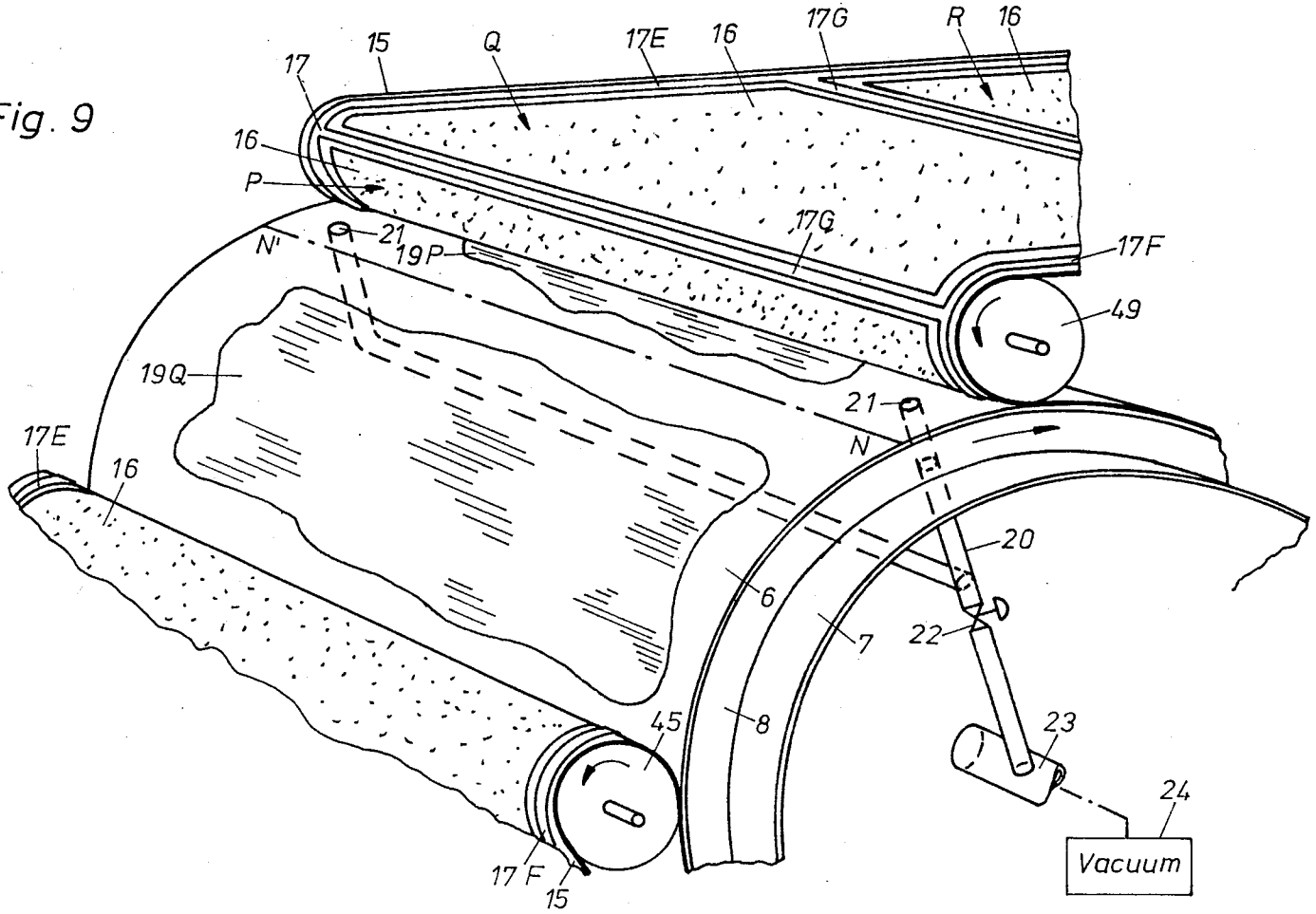
FIG. 9 is a fragmentary perspective view of the apparatus of FIG. 8.

In another embodiment of apparatus in accordance with the invention, as shown in FIGS. 8 and 9, a double-walled cylinder, constituted by an outer annular-section member 6, an inner annular-section member 7 and two end-plates 8, is supported, at the end parts of the inner annular-section member 7, on two pairs of rollers 4 and 5, themselves freely rotatable about pins supported by a stationary base 1.

A fluid-tight, flexible, but non-extensible, diaphragm 15, preferably of a synthetic material, engages a portion of the circumference of the outer annular section member 6 between the generating lines K and L, then engages with its opposite face, auxiliary cylinders 45, 46, 47, 48, 49, of which the axes extend parallel to the axis of the annular section members 6 and 7, rest on bearings (not shown) themselves secured to lateral supports, perpendicular to the axis of the annular-section members 6 and 7, rigid with thevbase 1 outwardly of the ends of the annular-section members 6 and 7. The diaphragm 15 takes the form of an endless belt, and the auxiliary cylinders 45 to 49 are so disposed that a portion of the outer surface of the annular-section member 6 is not covered by the diaphragm 15 and is thus freely accessible. The auxiliary cylinders 45 and 49 are so disposed that they press strongly the diaphragm 15 against the annular-section member 6.

On its face partially in contact with the annular-section member 6, but over the whole of its developed surface, the diaphragm 15 carries, adjacent to its lateral edges, two continuous bands 17E, 17F of a fluid-tight seal 17, the said bands 17E, 17F being inter-connected by a number of transverse bands 17G of the same seal, as can be seen in FIG. 8. These seal bands 17E, 17F and 17G are secured in a fluid-tight manner on the diaphragm 15 and define a plurality of equal sectors P, Q, R . . . , each of them having within the interior of the perimeter defined by the bands of the seal 17, a section of a cushion sheet of porous material 16. The auxiliary cylinder 45, driven by a variable speed drive means 13, drives the annular section member 6 in rotation in a clockwise sense through the diaphragm 15 itself. The length of each sector P, Q, R . . . in the direction of the movement of the endless diaphragm 15 on the one hand, the circumference of the annular-section member 6 on the other hand and the development of the diaphragm 15 are in such relationships that the circumference of the annular-section member 6 and the development of the diaphragm 15 correspond to a whole number of sectors P, Q, R . . . .

When the annular-section member 6 is rotating, as the rear transverse seal band 17G of the sector P and before the following sector Q comes into contact with the annular-section member 6 along the generating line N-N′, an article to be dried 19P is enclosed in a hermetically-closed space defined by the annular-section member 6, the diaphragm 15 and the four sides of the seal 17 relating to the sector P. The distributing valve 22 opens in order to generate vacuum in this space by means of aspirating tubes 20 and orifices 21 associated to this sector of the annular-section member 6.

A new article to be dried 19Q is spread out on the following sector of the annular-section member 6 and then commences to be, in its turn, enclosed in the interior of the perimeter of the sector Q of the diaphragm 15.

Simultaneously, a dry article begins to leave at the other end of the portion of the circumference of the annular-section member 6 covered by the diaphragm 15, that is to say, along the generating line of contact L of the auxiliary cylinder 45 with the annular-section member 6.

The operation continues in succession, the speed of rotation of the annular-section member 6 being controlled as a function of the drying time of the articles to be treated.

The diameter and the length of the annular-section member 6 and the number of the sectors P, Q, R . . . may be varied as a function of the dimensions of the articles to be dried and of the production to be carried out.

A modification of the preceding embodiment of apparatus in accordance with the invention consists in omitting the transverse bands of the seal 17G, and in providing the diaphragm 15, between the two continuous sealing bands 17E and 17F, with a likewise continuous cover of a cushion layer of porous material, the said cushion layer occupying the whole width between the two bands 17E and 17F, to which it is adhered by its edge portions in a fluid-tight manner.

Furthermore, the porous structure of this cushion layer is such that in the absence of pressure on its surfaces, air and vapor of water or solvents can circulate within its thickness, whilst a high-pressure along an essentially linear zone between its two opposite surfaces closes its structure, thus preventing the circulation of air and of vapor across the zone. The auxiliary cylinders 45 and 49 are so mounted that each of them exerts a very high pressure against the annular-section member 6, by means of hydraulic cylinders acting on their support shafts, for example. Because of this, along the generating lines K and L, the structure of the continuous cushion layer of porous material is closed in a fluid-tight manner by this very high pressure. The flat articles to be dried introduced along the generating line K in accordance with the rotation of the annular-section member 6 are then enclosed in a hermetically-closed space defined by the portion KML of the annular-section member 6, the diaphragm 15, the continuous sealing bands 17E and 17F and the generating lines K and L, a space in which vacuum can be generated by means of at least two tubes 20 and distributing valve 22 connected to the vacuum source. The valve 22 associated to a given orifice 21 is closed before the orifice reaches the generating line L and is re-opened after the orifice has passed the generating line K when the annular-section member 6 turns in the clockwise sense.

A completely continuous apparatus has thus been provided which is independent of the forms and dimensions of the articles to be dried, which articles can be freely disposed on the annular-section member 6 without limitation by sectors. The diameter and the length of the annular-section member 6 are a function of the largest dimensions of the articles to be dried and the required production, the speed of rotation being controlled as a function of the duration of the drying.

It should be understood that the embodiments hereinbefore described and shown in the drawings are given only by way of example, and imply no limitations to the invention in relation to the equivalents which can be applied.

I claim:

1. An apparatus for drying flat articles of porous material, said apparatus comprising a rotatably mounted cylinder having an outer annular wall, an inner annular wall, and annular end plates connecting the opposite ends of the outer annular wall and the inner annular wall so as to form a closed annular space therebetween, said annular space being capable of containing a heated fluid for heating the external surface of the outer annular wall, at least one cover means capable of wrapping around an associated portion of the external surface of the outer annular wall of said cylinder when said cylinder is rotated so as to cover any flat, porous articles located on said associated portion, each cover means comprising a flexible, nonextensible, fluid-tight diaphragm having a porous cushion layer on the surface thereof which will face the associated portion of the external surface of the outer annular wall of said cylinder when wrapped therearound, seal means positionable between each cover means and the associated portion of the external surface of the outer annular wall of said cylinder so as to form a hermetically-sealed space between each cover means and the associated portion of the external surface of the outer annular wall of said cylinder when each cover means is wrapped therearound, at least one orifice extending through said outer annular wall of said cylinder to communicate with each hermetically-sealed space, and means connected to each said orifice to create a vacuum therein and thus a vacuum in each hermetically-sealed space formed when each cover means is wrapped around the associated external surface of the outer annular wall of said cylinder.

2. The apparatus according to claim 1, including at least two cover means, and wherein each cover means includes a frame which is hingingly connected along one side to the external surface of the outer annular wall of said cylinder along an axially-extending line, each said frame being profiled to correspond in shape with the associated external surface of the outer annular wall of said cylinder, and wherein the flexible, non-extensible, fluid-tight diaphragm of each cover means is mounted on a corresponding frame so as to wrap an associated portion of the external surface of the outer annular wall of said cylinder when the frame is pivoted towards said cylinder.

3. The apparatus according to claim 2, including four cover means hingingly connected to the external surface of the outer annular wall of said cylinder so as to be equally spaced apart around the circumference thereof, the frame of each cover means having a profile corresponding with a quarter of the circumference of the external surface of the outer annular wall of said cylinder.

4. The apparatus according to claim 2, wherein a spring means is connected between the frame of each cover means and the outer annular wall of said cylinder to bias each frame around its respective hinge to an open position away from a wrapping position with respect to the outer annular wall of said cylinder, wherein said cylinder is partially surrounded by at least one fixed cam member arranged to cooperate with the frame of each cover means to maintain all but one in a wrapping position with respect to the outer annular wall of said cylinder, said open position of said but one cover means enabling the positioning of at least one flat article of porous material to be dried on the uncovered part of the external surface of the outer annular wall of said cylinder, and each said cover means being progressively pivoted to a wrapping position around the associated external surface of the outer annular wall of said cylinder via the action of said cam member on the frame thereof when said cylinder is rotated; wherein a variable speed drive means is connected to said cylinder to rotate said cylinder; and wherein said means connected to provide a vacuum in the orifices associated with a hermetically-sealed space are controlled by a distributing valve so as to open and cause a vacuum to be generated in the associated hermetically-sealed space when the associated cover means is pivoted to thus form a hermetically-sealed space with the associated external surface of the outer annular wall of said cylinder and to close and stop a vacuum from being generated when the associated cover means is pivoted away from said associated external surface.

5. The apparatus according to claim 1 wherein said seal means comprises a sealing strip attached to the periphery of each cover means.

6. The apparatus according to claim 1 wherein said seal means comprises at least one sealing strip attached to the external surface of the outer annular wall of said cylinder.

7. The apparatus according to claim 1 wherein each means connected to each orifice to create a vacuum therein includes an elongated tube that is connected at one end to each orifice and extends through said annular space and said inner annular wall to connect at its opposite end to a vacuum-generating means located within said inner annular wall.

8. The apparatus according to claim 1, including only a single cover means capable of wrapping around an associated portion of the external surface of the outer annular wall of said cylinder, the cover means having a rectangular configuration and being elongated sufficiently to wrap around substantially the entire circumference of the outer annular wall of said cylinder, the seal means positioned between the cover element and the external surface of the outer annular wall of said cylinder being in the form of a sealing strip having four sides, one of said sides being locatable on a first straight generating line of the outer annular wall of said cylinder, the opposed side being locatable on a second straight generating line of the outer annular wall of said cylinder situated closely to the first generating line, and the remaining sides being locatable on two arcs of the circumference of the outer annular wall of said cylinder, each of the remaining sides being situated adjacent to one of the ends of the outer annular wall of said cylinder.

9. The apparatus according to claim 2, including a drum rotatably mounted adjacent said cylinder; wherein one of the edges of said cover means is secured along said first generating line of the outer annular wall of said cylinder and the opposing edge of said cover means is secured along a generating line of said drum, said cover means being windable on said drum in the inverse sense of its winding around the outer annular wall of said cylinder, said drum being mounted on an oscillatory frame which is spring biased towards said cylinder such that the drum is pressed against the external surface of the outer annular wall of said cylinder along a common straight generating line.

10. The apparatus according to claim 9, including a reversible motor/reduction gear connected to said drum, said gear having different forward and backward speeds so as to be able to rotate both the drum and the cylinder, and wherein said gear operates to rotate said drum at a lower speed during the wrapping of the cover means from the drum around the external surface of the outer annular wall of said cylinder until the hermetically-sealed space between the cover means and the external surface of the outer annular wall of said cylinder is created and at a higher speed during the inverse winding of the cover means onto the drum.

11. The apparatus according to claim 1, including only a single cover means in the form of an endless belt, wherein a number of auxiliary rollers are positioned adjacent said cylinder, said endless belt being mounted around said auxiliary rollers such that one of its sides is wrapped around a portion of the circumference of the outer annular wall of said cylinder, the remaining portion of the circumference of the outer annular wall of said cylinder being freely accessible, said means connected to the orifices extending through the outer annular wall of said cylinder to create a vacuum in a hermetically-sealed space between the cover means and the outer annular wall of said cylinder also including a distributing valve operable to be open when the orifices lie below the cover means as the cylinder rotates and closed when the openings lie in the freely accessible portion of the circumference of the outer annular wall of said cylinder as the cylinder rotates.

12. Apparatus according to claim 11, wherein the cushion layer on the side of said endless belt which wraps the external surface of the outer annular wall of said cylinder comprises a number of equal sections and wherein the seal means comprises two continuous sealing strips disposed adjacent lateral edges of the cover means as well as a number of transverse sealing strips interconnecting the continuous sealing strips and disposed between the sections of the cushion layer, the external surface of the outer annular wall of said cylinder having several orifices at least equal in number to the number of transverse sealing strips of the seal means and so disposed that at least one of the orifices lies within the interior of each perimeter circumscribed by the sealing strips of the seal means which are in contact with the external surface of the outer annular wall of said cylinder, each of the orifices associated with a particular perimeter interior being connected to a vacuum-generating means via a distributing valve.

13. The apparatus according to claim 11, wherein the seal means comprises two continuous sealing strips disposed adjacent to the lateral edges of the cover means and wherein the porous cushion layer the form of a continuous cover occupying the whole width between the continuous sealing strips of the sealing means to which it is connected, by its lateral edges, in a fluid-tight manner, the porous structure of the said cushion layer being such that in the absence of pressure on its opposite surfaces, air and vapours can circulate within its thickness, while a high pressure acting between its two surfaces, exerted by each of at least two of the auxiliary rollers against the outer annular wall of said cylinder along substantially straight linear zones, closes the structure and renders it impermeable to air and vapours in the linear zones.

14. The apparatus according to claim 13, wherein a reduction speed drive means is connected to one of the auxiliary rollers in order to drive the cover means wrapped therearound and thus drive the cover means around the cylinder.

* * * * *